US005971528A

United States Patent [19]

Yoshimura

[11] Patent Number: 5,971,528

[45] Date of Patent: Oct. 26, 1999

[54] PIEZOELECTRIC INK JET APPARATUS HAVING NOZZLES DESIGNED FOR IMPROVED JETTING

[75] Inventor: Manabu Yoshimura, Nagoya, Japan

[73] Assignee: Brother Kogyo Kabushiki Kaisha, Nagoya, Japan

[21] Appl. No.: 08/735,949

[22] Filed: Oct. 23, 1996

Related U.S. Application Data

[63] Continuation of application No. 08/148,507, Nov. 8, 1993, abandoned.

[30] Foreign Application Priority Data

Feb. 26, 1993 [JP] Japan ..... 5-037882

[51] Int. Cl.[6] ..... B41J 2/045

[52] U.S. Cl. ..... 347/69; 347/71

[58] Field of Search ..... 347/68, 69, 71, 347/44, 47

[56] References Cited

U.S. PATENT DOCUMENTS

| | | | |
|---|---|---|---|
| 4,313,684 | 2/1982 | Tazaki et al. . | |
| 4,587,534 | 5/1986 | Saito et al. | 347/47 |
| 4,611,219 | 9/1986 | Sugitani et al. | 347/47 X |
| 4,879,568 | 11/1989 | Bartky et al. | 347/69 |
| 4,887,100 | 12/1989 | Michaelis et al. | 347/69 |
| 4,967,208 | 10/1990 | Childers | 347/47 |
| 5,016,028 | 5/1991 | Temple | 347/69 |
| 5,059,973 | 10/1991 | Watanabe | 347/47 |
| 5,193,256 | 3/1993 | Ochiai et al. | 347/71 X |
| 5,291,226 | 3/1994 | Schantz et al. | 347/47 |

FOREIGN PATENT DOCUMENTS

| | | |
|---|---|---|
| 0-364136 A3 | 4/1990 | European Pat. Off. . |
| 0-483843 A1 | 5/1992 | European Pat. Off. . |
| 0-513971 A3 | 11/1992 | European Pat. Off. . |
| 0-528440 A1 | 2/1993 | European Pat. Off. . |
| 59-187871 | 10/1984 | Japan . |

OTHER PUBLICATIONS

Akira Asai et al., "One–Dimensional Model of Bubble Growth and Liquid Flow in Bubble Jet Printers", *Japanese Journal of Applied Physics,* pp. 1794–1801, vol. 26, No. 10, Oct. 1987.

White, Frank M., "Fluid Mechanics", McGraw–Hill. Inc., pp. 14–15, 134–136, 538–543, 1986.

*Primary Examiner*—N. Le
*Assistant Examiner*—Judy Nguyen
*Attorney, Agent, or Firm*—Oliff & Berridge, PLC

[57] ABSTRACT

An ink jet apparatus offers enhanced print quality and is highly conducive to mass-production. The apparatus has a piezoelectric ceramic arrangement including a plurality of ink channels filled with ink. The ink channels are defined by walls and correspond to nozzles. The walls are deformed selectively by a piezoelectric effect to vary the volumes of the selected ink channels to jet out the ink through the corresponding nozzles. The center position of each of the nozzles is allowed to deviate from the middle between one wall of the corresponding ink channel and the other wall opposite thereto by half the distance between the two walls minus half the diameter of the nozzle within the half distance. This arrangement reduces the number of defective ink jet printer heads in the manufacturing phase and allows the ink jet apparatus to offer enhanced print quality. Such an apparatus is also highly conducive to mass-production with no need for specialized adjustments of individual nozzles.

14 Claims, 7 Drawing Sheets

$$\left(\begin{array}{l} a = L/2 - D_1/2 = 45-15 = 30\mu m \\ b = L/2 - D_2/2 = 45-22.5 = 22.5\mu m \end{array}\right)$$

PIEZOELECTRIC INK JET APPARATUS HAVING NOZZLES DESIGNED FOR IMPROVED JETTING

This is a Continuation of application Ser. No. 08/148,507 filed Nov. 8, 1993, now abandoned.

BACKGROUND OF THE INVENTION

1. Field of the Invention

The present invention relates to an ink jet apparatus having a piezoelectric ceramic arrangement comprising ink channels separated by walls and filled with ink. The walls of the ink channels are selectively deformed by the piezoelectric effect to vary the volumes of the channels so that the ink therein will be jetted out through the nozzles corresponding to those channels.

2. Description of the Related Art

The above type of ink jet apparatus has been conventionally used in ink jet printers. A first example of a typical prior art ink jet apparatus is outlined below with reference to FIG. 6. In FIG. 6, each ink chamber 70 is formed by a housing 72 including side walls 74 equipped with piezoelectric ceramic devices 76. Electrodes 77 are furnished on both sides of each piezoelectric ceramic device 76 and are connected to a driving circuit 79.

When the driving circuit 79 applies a driving voltage to the electrodes 77, the piezoelectric ceramic device 76 attached thereto is deformed accordingly. With the piezoelectric ceramic device 76 deformed, the side wall 74 is deformed into a shape indicated by the dashed line in FIG. 6, thereby reducing the volume of the ink chamber 70. The reduction in the volume of the ink chamber 70 causes the ink therein to jet out as an ink droplet 80 through a nozzle 82.

Thereafter, with the driving voltage removed, the piezoelectric ceramic device 76 returns to its original shape and thus increases the volume of the ink chamber 70. The increase in the volume of the ink chamber 70 introduces additional ink thereinto through an ink conduit 84. Typically, ink jet printers comprise numerous ink chambers 70 when manufactured.

A second example of a typical prior art ink jet apparatus is outlined below with reference to FIG. 7. In FIG. 7, an ink jet printer head 1 comprises a piezoelectric ceramic plate 2, a cover plate 3, a nozzle plate 31 and a substrate 41.

The piezoelectric ceramic plate 2 has a plurality of grooves 8. Side walls 11 defining the grooves 8 are polarized in the direction shown by arrow 5. The grooves 8 are of a uniform depth and are parallel. The grooves 8 become gradually shallower as they approach an edge 15 of the piezoelectric ceramic plate 2. Near the edge 15, the grooves 8 merge into shallow grooves 16. Inside the grooves 8, the upper half of each of the side walls 11 is covered with a metal electrode 13 formed thereon by sputtering or by other suitable processes. Inside the shallow grooves 16, the entire side walls and the bottoms are covered with metal electrodes 9 deposited by sputtering or by other suitable processes. In this arrangement, the metal electrodes 13 formed on both sides of each groove 8 are connected electrically to the metal electrodes 9 furnished over the shallow grooves 16.

The cover plate 3 is made of ceramic or plastic resin. On the cover plate 3, ink inlet ports 21 and manifolds 22 are formed by grinding or by cutting. The side of the piezoelectric ceramic plate 2 having the grooves 8 formed thereon is bonded using epoxy resin adhesive or the like to the side of the cover plate 3 having the manifolds 22 machined thereon.

Covering the top of the grooves 8 in this manner with the plate 3 forms a plurality of ink channels 12 (FIG. 9) spaced apart crosswise in the ink jet printer head 1. Each ink channel 12 has a rectangular cross section and is long and narrow in shape. All ink channels 12 are filled with ink during operation.

The nozzle plate 31 is attached to one end of the piezoelectric ceramic plate 2 and the cover plate 3. The nozzle plate 31 has nozzles 32 formed in the positions corresponding to the ink channels 12. The nozzle plate 31 is made of plastic such as polyalkylene (e.g., ethylene), terephthalate, polyimide, polyether imide, polyether ketone, polyether sulfone, polycarbonate or cellulose acetate.

A substrate 41 is bonded using epoxy resin adhesive or the like to the surface opposite to the side of the piezoelectric ceramic plate 2 having the grooves 8. The substrate 41 has conductive layer patterns 42 corresponding to the positions of the ink channels 12. The metal electrodes 9 at the bottoms of the shallow parallel grooves 16 are connected to the conductive layer patterns 42 by conductors 43 deposited by wire bonding.

The control section of the prior art apparatus is described with reference to FIG. 8, which is a schematic diagram of the control section. Each of the conductive layer patterns 42 on the substrate 41 is connected individually to an LSI chip 51. Also connected to the LSI chip 51 are a clock line 52, a data line 53, a voltage line 54 and a grounding line 55. Given continuous clock pulses through the clock line 52 as well as data from the data line 53, the LSI chip 51 decides through which of the nozzles 32 ink droplets are to be jetted out. Based on its decision, the LSI chip 51 selectively applies the voltage V of the voltage line 54 to the conductive layer patterns 42 connected to the metal electrodes 13 that belong to the target ink channels 12. The LSI chip 51 also applies a zero voltage of the grounding line 55 to those conductive layer patterns 42 connected to the metal electrodes 13 associated with ink channels 12 that are not targetted for jetting.

The operation of the ink jet printer head 1 is described with reference to FIGS. 9 and 10. Suppose that, given appropriate data, the LSI chip 51 decides that an ink droplet is to be jetted out from an ink channel 12*b*. Then, a positive driving voltage V is applied to metal electrodes 13*e* and 13*f* while metal electrodes 13*d* and 13*g* are connected to ground. This develops a driving electric field in a side wall 11*b* in the direction of arrow 14*b* and another driving electric field in a side wall 11*c* in the direction of arrow 14*c*, as illustrated in FIG. 10. Because the directions 14*b* and 14*c* of the driving electric fields are each perpendicular to the direction of polarization 4, the side walls 11*b* and 11*c* are deformed rapidly toward the inside of the ink channel 12*b* due to the piezoelectric thickness slip effect. The side wall deformation reduces the volume of the ink channel 12*b* and rapidly raises the ink pressure therein. The resulting pressure wave causes an ink droplet to be jetted out through the nozzle 32 (FIG. 7) connected to the ink channel 12*b*.

One disadvantage of the prior art ink jet apparatus is that the nozzle 32 is located inside each ink channel 12, i.e., the position of the nozzle 32 is not fixed definitively relative to the ink channel 12. The center positions of the nozzles 32 may or may not be aligned with the centers of the ink channels 12. The flow rate of ink at the center of each ink channel 12 can differ from the flow rate off the center thereof. The differences in ink flow rate can translate into different jet speeds of ink droplets from the nozzles, causing the print speed to vary from one ink jet printer head 1 to another. Such speed discrepancies can render the ink jet printer head 1 nonconducive to mass-production.

On the same ink jet printer head 1, the center positions of individual nozzles 32 may or may not be aligned with the centers of the corresponding ink channels 12. This means that the jet speed of ink droplets can vary from nozzle to nozzle 32 on the same printer head. The jet speed discrepancies can lead to a serious deterioration of print quality with the ink jet printer head 1. In some cases, the printer head does not function outright. As a result, there can be many defective ink printer heads if the printer heads are mass-produced.

On the prior art ink jet apparatus, the nozzles 32 are thought to jet out ink droplets in more stable quantities and at more stable speeds when narrowed progressively (i.e, tapered) toward the ink jetting side from the ink channel side than when shaped otherwise (i.e., widened progressively toward the ink jetting side from the ink channel side, or bored straight to have the same diameter at both the ink jetting side and the ink channel side). Conventionally, however, there is no strictly determined ratio of the sectional area of the nozzle on the ink jetting side to that on the ink channel side. That ratio can be disproportionately large on one ink jet printer head and inordinately small on another. As a result, the jet speed of ink droplets, and hence the print speed, may vary from one ink jet printer head 1 to another. Such speed discrepancies can lead to a deterioration of print quality with ink jet printer heads, rendering them nonconducive to mass-production.

On the same ink jet printer head 1, the ratio of the sectional area of the nozzle on the ink jetting side to that on the ink channel side can vary significantly from one individual nozzle to another. This means that the jet speed of ink droplets can vary from nozzle to nozzle on the same printer head. The jet speed discrepancies can lead to a serious deterioration of print quality with the ink jet printer head 1. In some cases, the printer head does not function outright. As a result, there can be many defective ink printer heads if the printer heads are mass-produced.

Furthermore, with the prior art ink jet apparatus, there is no definitely determined taper angle θ at which the diameter of the nozzle 32 is narrowed progressively from the ink channel side toward the ink jetting side. The taper angle can be disproportionately large on one ink jet printer head and inordinately small on another. As a result, the jet speed of ink droplets, and hence the print speed, may vary from one ink jet printer head 1 to another. Such speed discrepancies can lead to a deterioration of print quality with ink jet printer heads, rendering them nonconducive to mass-production.

On the same ink jet printer head 1, the nozzle taper angle can vary significantly from one individual nozzle to another 32. This means that the jet speed of ink droplets can vary from nozzle to nozzle 32 on the same printer head. The jet speed discrepancies can lead to a serious deterioration of print quality with the ink jet printer head 1. In some cases, the printer head does not function outright. As a result, there can be many defective ink printer heads where the printer heads are mass-produced.

With ink jet apparatuses, the minimum sectional area of the nozzle 32 must be greater than the maximum projected area of solid ink particles to ensure good ink jet performance. Conventionally, however, there is no fixedly determined ratio of the minimum sectional area of the nozzle to the maximum projected area of solid ink particles. Whereas there is little problem if the sectional area of the nozzles on their ink jetting side is sufficiently large compared with the maximum projected area of solid ink particles, an insufficient sectional area of the nozzles can change the jet speed of ink droplets due to the friction between the nozzles and solid ink particles. The varying jet speeds can also vary the print speed from one ink jet printer head 1 to another. Such speed discrepancies can lead to a deterioration of print quality with ink jet printer heads, rendering them nonconducive to mass-production.

On the same ink jet printer head 1, some nozzles 32 may have insufficient sectional areas compared with the maximum projected area of solid ink particles while others have sufficient sectional areas. This means that the jet speed of ink droplets can vary from one individual nozzle 32 to another on the same printer head. The jet speed discrepancies can lead to a serious deterioration of print quality with the ink jet printer head 1. In some cases, the printer head does not function outright. As a result, there can be many defective ink printer heads if the printer heads are mass-produced.

SUMMARY OF THE INVENTION

It is therefore a primary object of the present invention to overcome the above and other deficiencies and disadvantages of the prior art and to provide an ink jet apparatus that offers enhanced print quality and is highly conducive to mass-production.

According to one aspect of the invention, an ink jet apparatus has a piezoelectric ceramic arrangement including a plurality of ink channels filled with ink, the ink channels being formed by walls and corresponding to nozzles. The walls are selectively deformed by the piezoelectric effect to vary the volumes of the selected ink channels to jet out the ink inside through the corresponding nozzles. The center position of each of the nozzles is allowed to deviate from the middle between one wall of the corresponding ink channel and the other wall opposite thereto by half the distance between the two walls minus half the diameter of the nozzle within each half distance of the channel.

In a preferred structure according to the invention, the nozzles are furnished on a nozzle plate that is positioned so that the nozzles will correspond to the ink channels.

According to another aspect of the invention, the ratio of the sectional area of each of the nozzles on the ink jetting side to that on the ink channel side ranges from 1:2 to 1:50.

According to a further aspect of the invention, the minimum sectional area of each of the nozzles is at least four times the maximum projected area of solid ink particles.

According to an even further aspect of the invention, the taper angle θ, at which the diameter of each of the nozzles is narrowed progressively from the ink channel side toward the ink jetting side, ranges from five to 30 degrees.

In operation, the jet speed of ink droplets is increased significantly with the inventive ink jet apparatus in any one of the following four cases. First, the jet speed of ink droplets increases when the center position of each of the nozzles is allowed to deviate from the middle between one wall of the corresponding ink channel and the other wall opposite thereto by half the distance between the two walls minus half the diameter of the nozzle within the half distance. Second, the jet speed of ink droplets increases when the ratio of the sectional area of each of the nozzles on the ink jetting side to that on the ink channel side ranges from 1:2 to 1:50. Third, the jet speed of ink droplets increases when the minimum sectional area of each of the nozzles is at least four times the maximum projected area of solid ink particles. Further, the jet speed of ink droplets increases when the taper angle θ at which the diameter of each of the nozzles is narrowed progressively from the ink channel side toward the ink jetting side ranges from five to 30 degrees.

These and other objects, features and advantages of the invention will become more apparent upon a reading of the following description and appended drawings.

DESCRIPTION OF THE PREFERRED EMBODIMENT

The preferred embodiment of the invention will now be described with reference to the accompanying drawings. The basic constitution and workings of the embodiment are the same as those of the second prior art example and will not be discussed further.

Figure 2:
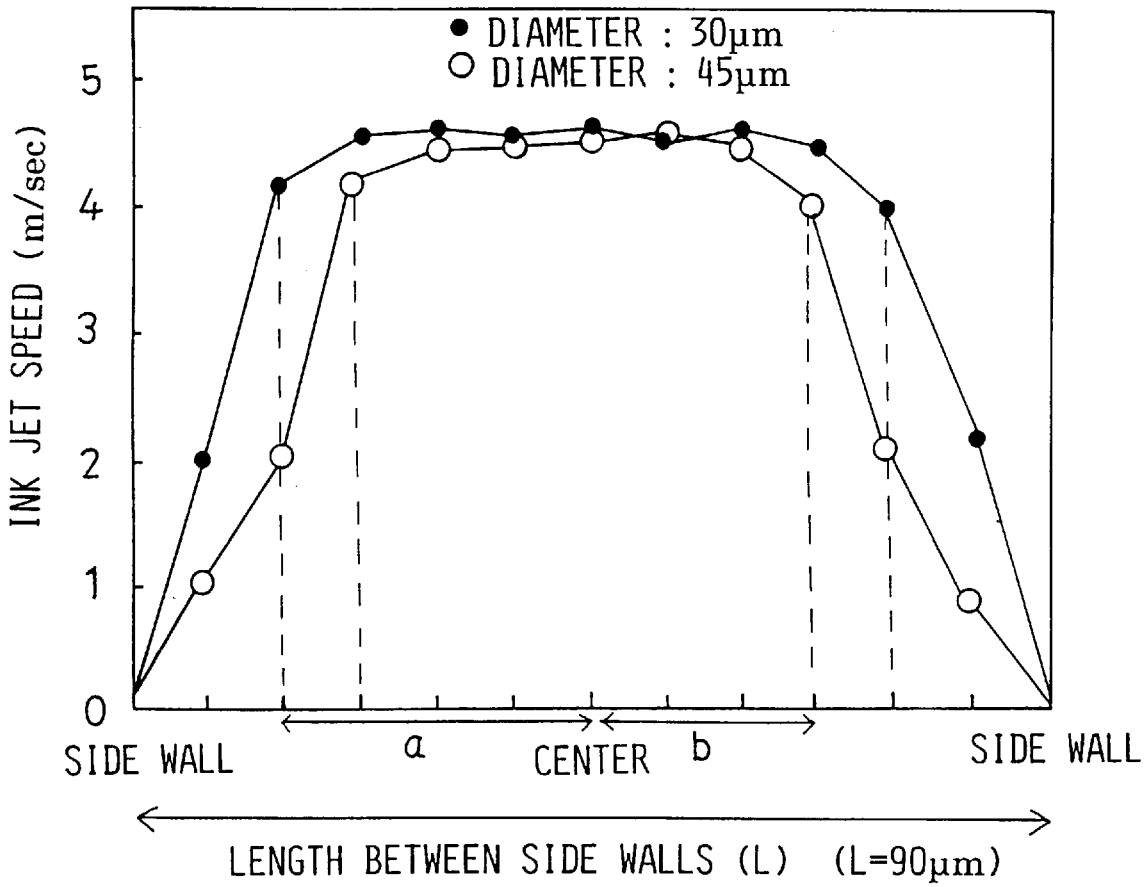
FIG. 2 is a graph depicting typical relations between the nozzle center position and the ink jet speed in connection with the embodiment.

Described first is where the center of each nozzle 32 is to be located with respect to the corresponding ink channel 12. In developing the apparatus, the inventor measured the jet speeds of ink droplets while varying the center position of the nozzle 32 relative to the ink channel 12. Specifically, a strobe light device was made to emit light at varying intervals so that the jetted ink droplets would synchronize with the light emissions. The light emission intervals in synchronism with the jetted ink droplets were measured and translated into the jet speeds of the ink droplets. FIG. 2 depicts typical relations between the position of the center of each nozzle 32 and the ink jet speeds measured in the above manner.

FIG. 2 plots measurements from two cases, one in which the diameter D1 of the nozzle 32 was 30 μm and the other in which the diameter D2 of the nozzle 32 was 45 μm. The two cases shared the same setup wherein the length L between two side walls 11 (i.e., width of the ink channel 12) was 90 μm and the height of the walls was 300 μm. The center of the nozzle 32 was 300 μm high. During the measurement of ink jet speeds using the setup above, the center of the nozzle 32 was moved away from the middle between one side wall 11 of the ink channel 12 and the other side wall opposite thereto, in units of 7.5 μm, i.e., 1/12 of the distance between the two side walls.

As shown in FIG. 2, where the diameter D1 of the nozzle 32 was 30 μm, the measured jet speeds of ink droplets were the highest and were relatively stable as the center of the nozzle 32 was moved away from the inter-wall middle by 15.0 μm to 75.0 μm. Where the diameter D2 of the nozzle 32 was 45 μm, the measured jet speeds of ink droplets were the highest and were relatively stable as the center of the nozzle 32 was moved away from the inter-wall middle by 22.5 μm to 67.5 μm.

It follows that, in more general terms, the jet speed of ink droplets is the highest and is relatively stable when the center of the nozzle 32 is allowed to deviate from the middle of the two adjacent side walls 11 by half the distance between the two walls minus half the diameter D of the nozzle 32 within each half distance of the channel.

Although not shown, the height of the center of the nozzle 32 from the channel bottom was also varied as the nozzle center was moved away from the inter-wall middle in units of 7.5 μm for measurement of ink jet speeds. The trend obtained was the same as that in effect where the center of the nozzle 32 remained unchanged in height. That is, the center position of the nozzle 32 with respect to the ink channel 12 was not affected by how high or how low the nozzle 32 was located relative to the channel bottom.

In other experiments, the inventor adopted other diameters D of the nozzle 32 to measure the jet speeds of ink droplets while the nozzle center position was varied crosswise between the two adjacent side walls 11 as well as vertically within the ink channel 12. The trend obtained was the same as that in effect where the diameter D1 was 30 μm and where the diameter D2 was 45 μm.

Figure 1:
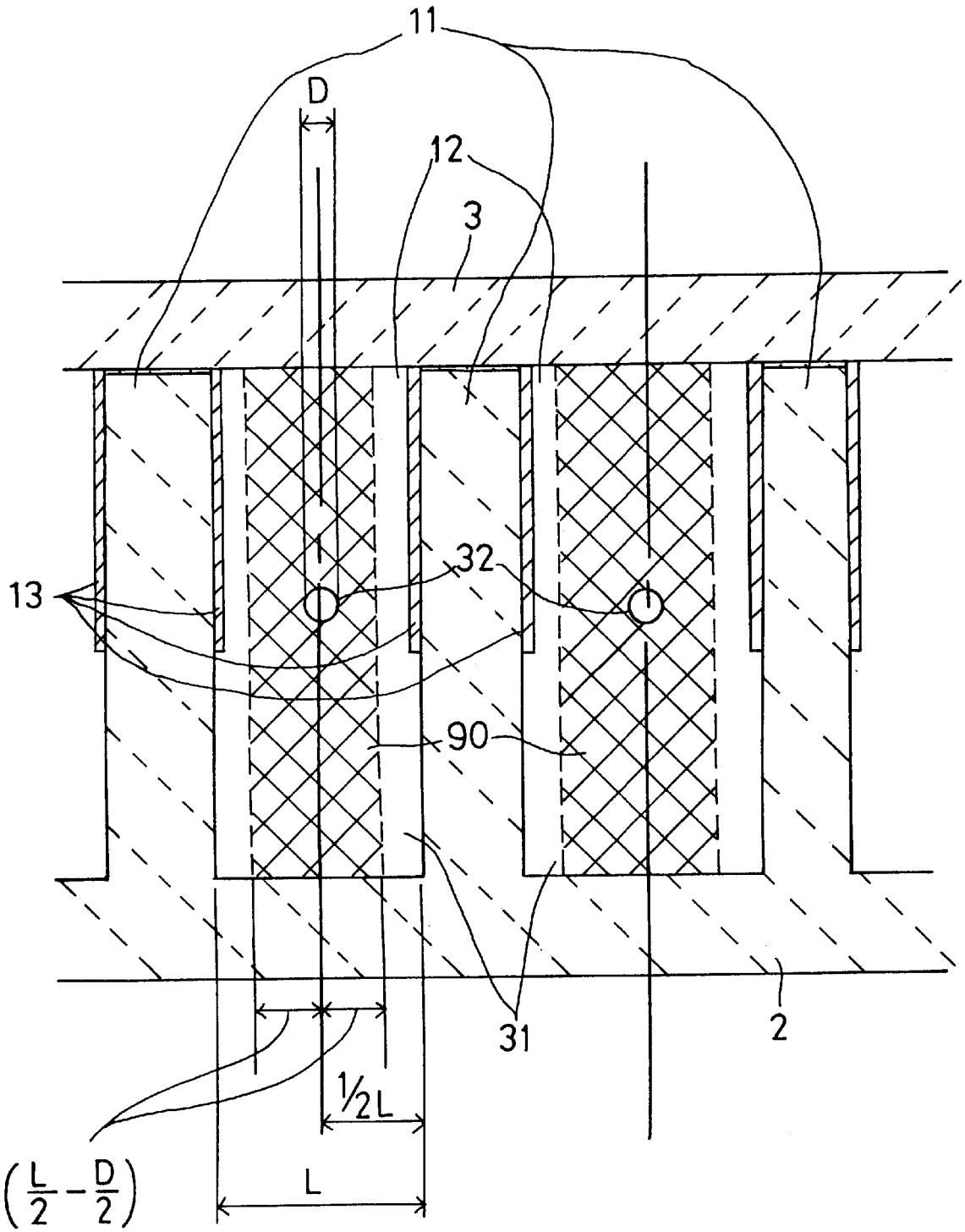
FIG. 1 is a partial enlarged sectional front view showing where the center of each nozzle is located in an ink jet apparatus embodying the invention.

This means that the jet speed of ink droplets is the highest and relatively stable when the center of the nozzle 32 is allowed to deviate from the middle of the two adjacent side walls 11 by half the distance between the two walls minus half the diameter D of the nozzle 32 within the half distance (i.e., the hatched range 90 in FIG. 1).

The amount of deformation in each side wall 11 having the above-described size was about 30 μm, a very small quantity compared with the size of the nozzle 32. Fluctuations in the deformed amount of the side walls are thus negligible relative to the size of the nozzle 32. That is, the same trend as that shown in FIG. 2 is in effect regardless of the variations in the deformation of the side walls 11.

If the nozzles 32 are formed on the nozzle plate 31 in such a manner that the center of each nozzle will be located within the allowable range designated above, the jet speed of ink droplets is kept high and relatively stable. This means that the accuracy with which to position the center of each nozzle 32 need not be very high. If the nozzle plate 31 is mounted in such a manner that the nozzles 32 thereon will have their centers positioned as required above, the jet speed of ink droplets is also held high and relatively stable. Thus, the accuracy with which to position the center of each nozzle 32 with respect to the ink channel 12 need not be very high. The centers of individual nozzles 32 may deviate from the middle between two adjacent side walls as long as each nozzle center is located within a certain range with respect to each ink channel 12. This kind of constitution reduces the number of defective ink jet printer heads in the manufacturing phase. Thus, the ink jet apparatus according to the invention offers enhanced print quality and is highly conducive to mass-production with no need for specialized adjustments of individual nozzles.

The shape of the nozzle 32 will be described next. It is generally considered that the nozzle jets out ink droplets in more stable quantities and at more stable speeds when narrowed progressively (i.e, tapered). Specifically, the nozzle is narrowed toward the ink jetting side. Such a tapered nozzle jets ink droplets in more stable quantities and speeds from the ink channel side than when shaped otherwise (i.e., widened progressively toward the ink jetting side from the ink channel side, or bored straight to have the same diameter at both the ink jetting side and the ink channel side).

The inventor measured the jet speeds of ink droplets while varying the ratio of the sectional area of each nozzle 32 on the ink jetting side to that on the side of the ink channel 12. The method of measuring the ink jet speeds was the same as that described earlier. The measurements taken are plotted in FIG. 3.

Figure 3:
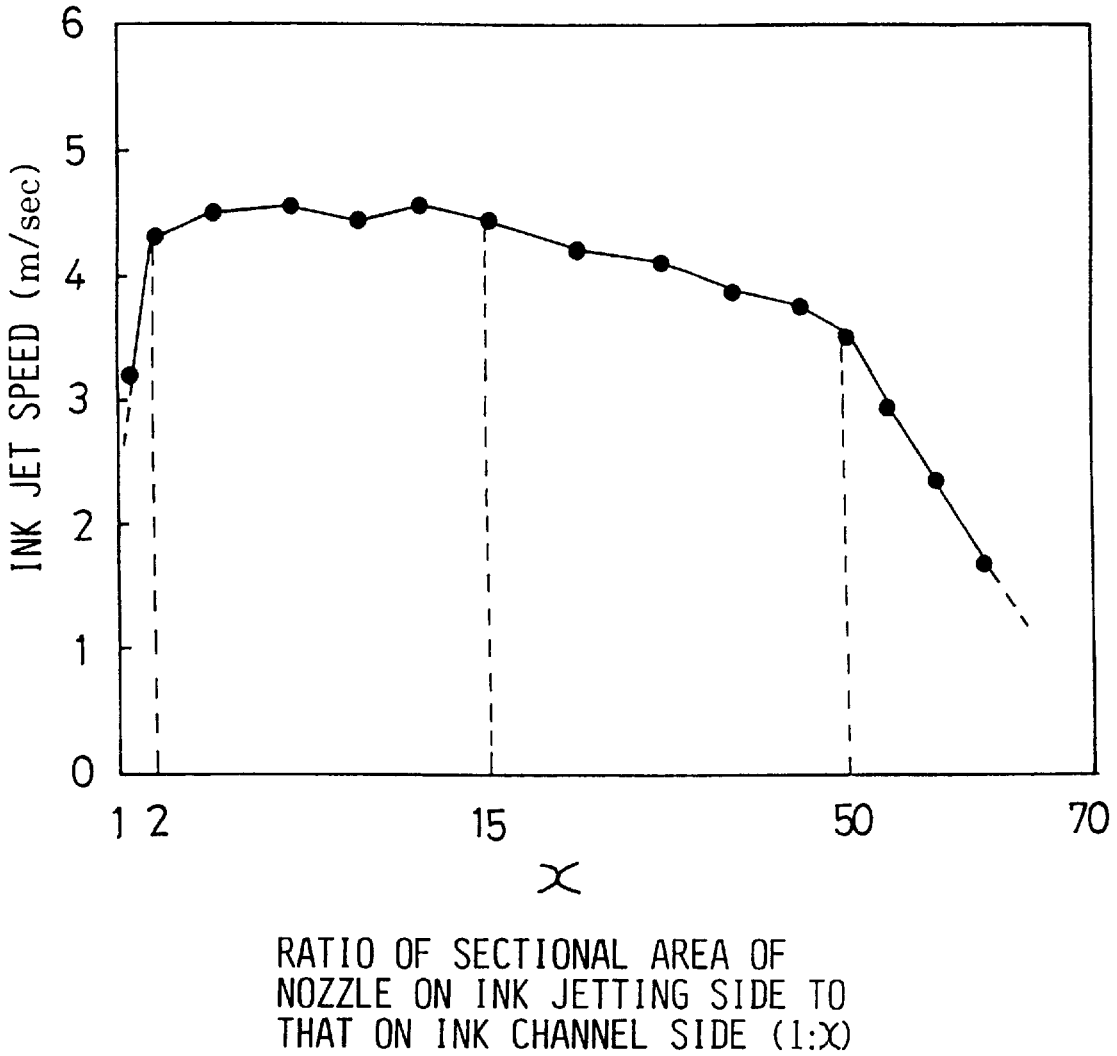
FIG. 3 is a graph illustrating typical relations between the ratio of the sectional area of each nozzle on the ink jetting side to that on the ink channel side on the one hand, and the ink jet speed on the other in connection with the embodiment.

FIG. 3 illustrates typical relations between the ratio of the sectional area of each nozzle 32 on the ink jetting side to that on the ink channel side on the one hand, and the ink jet speed on the other. In this case, the diameter of the nozzle 32 on the ink jetting side was fixed to 30 $\mu$m while the nozzle diameter on the side of the ink channel 12 was varied. The center of each nozzle 32 was positioned in the approximate middle of the ink channel 12 as it was flanked by side walls. The ink channel 12 was 90 $\mu$m in width and 300 $\mu$m in height.

As depicted in FIG. 3, the measured jet speeds of ink droplets were relatively high and stable when the ratio of the sectional area of each of the nozzles 32 on the ink jetting side to that on the side of the ink channels 12 ranged from 1:2 to 1:50, and preferably from 1:2 to 1:15.

Similar results were obtained when the center position of the nozzle 32 was moved within the allowable range designated earlier. Furthermore, similar trends were acquired when the diameter of each nozzle 32 was varied on the ink jetting side.

When the ratio of the sectional area of each of the nozzles 32 on the ink jetting side to that on the side of the ink channels 12 ranges from 1:2 to 1:50, the measured jet speeds of ink droplets are high and stable. This affords enhanced degrees of freedom to the designing of nozzles 32. Even if manufacturing error causes some deviations in the shape of each nozzle 32, the speeds of ink droplets jetted from each nozzle 32 remain stable as long as the ratio of the sectional area of each nozzle on the ink jetting side to that on the ink channel side ranges from 1:2 to 1:50. This kind of arrangement reduces the number of defective ink jet printer heads in the manufacturing phase. Thus, the ink jet apparatus according to the invention offers enhanced print quality and is highly conducive to mass-production with no need for specialized adjustments of individual nozzles.

Figure 4A:
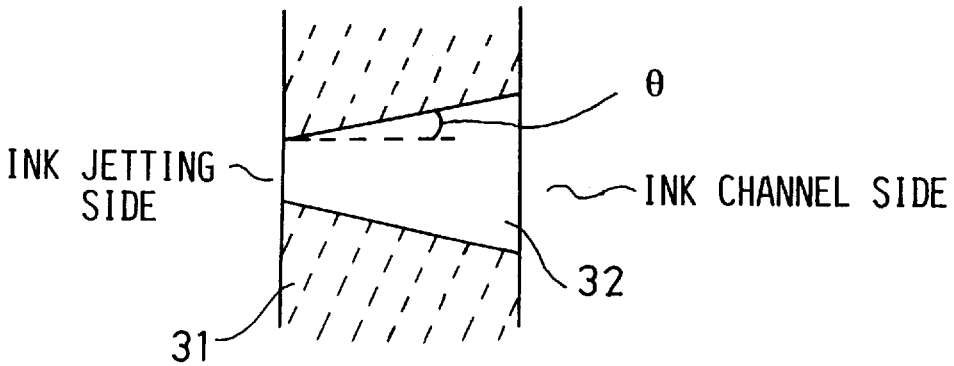
FIG. 4(A) is a partial sectional side view portraying the nozzle taper angle in the preferred embodiment.

Next, the inventor measured the jet speeds of ink droplets while varying the taper angle $\theta$ illustrated in FIG. 4(A). The method of measuring the ink jet speeds was the same as that described above. The results are plotted in FIG. 4(B).

Figure 4B:
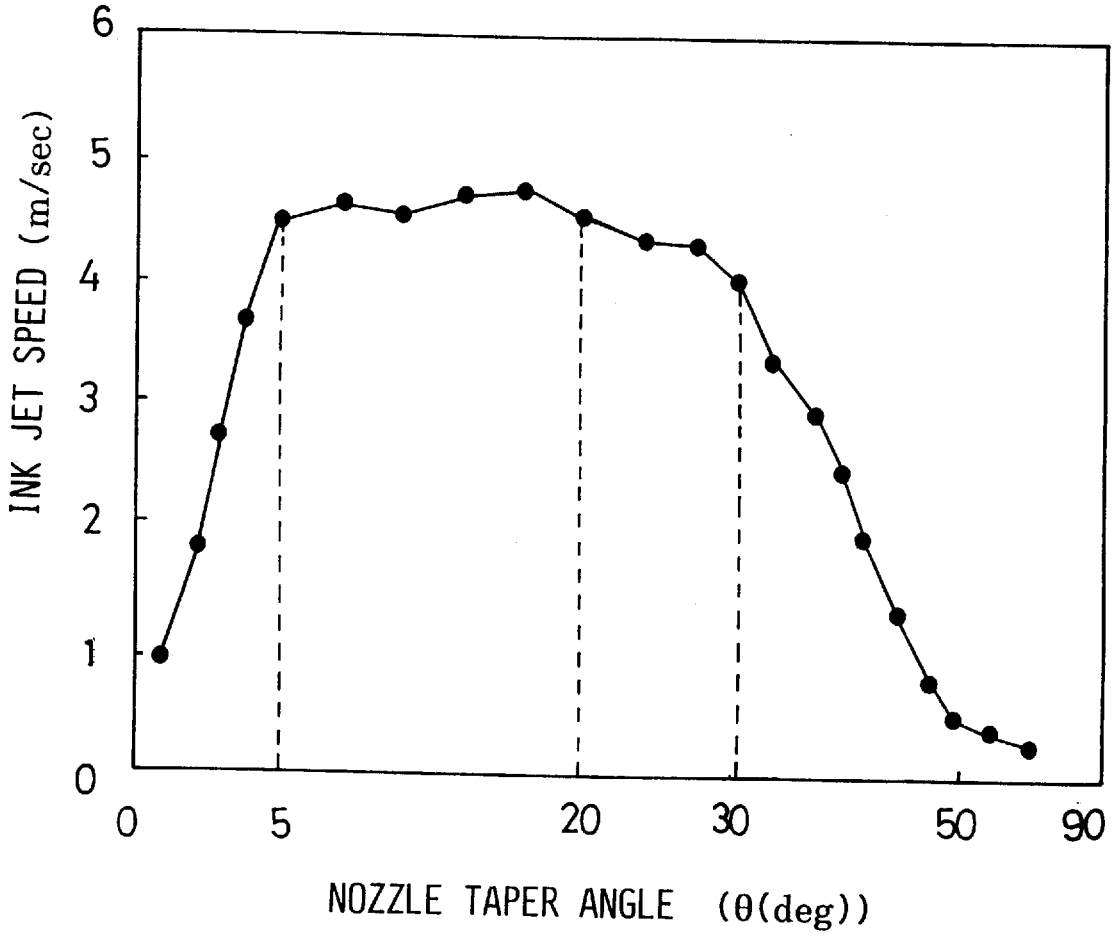
FIG. 4(B) is a graph indicating typical relations between the nozzle taper angle and the ink jet speed in connection with the embodiment.

FIG. 4(B) indicates typical relations between the nozzle taper angle $\theta$ and the ink jet speed in effect when the diameter of each nozzle 32 was fixed to 30 $\mu$m on the ink jetting side while the taper angle $\theta$ was varied. In this setup, the ratio of the sectional area of each nozzle 32 on the ink jetting side to that on the ink channel side ranged from 1:1.5 to 1:15. The center of each nozzle 32 was positioned in the approximate middle of the ink channel 12 as it was flanked by two side walls. Each ink channel 12 was 90 $\mu$m wide and 300 $\mu$m high.

As shown in FIG. 4(B), the measured jet speeds of ink droplets were relatively high and stable when the taper angle $\theta$ of the nozzle 32 ranged from five to 30 degrees, and preferably from five to 20 degrees.

Measurements were also taken while the diameter of each nozzle 32 on the ink jetting side was varied. The results obtained were the same. Furthermore, measurements were taken while the center of each nozzle 32 was moved away from the inter-wall middle within the allowable range stipulated above. The results acquired were also the same.

When the taper angle $\Theta$ of each nozzle 32 ranges from five to 30 degrees, the jet speeds of ink droplets are held high and stable. This affords enhanced degrees of freedom to the designing of nozzles 32. Even if manufacturing error causes some deviations in the shape of each nozzle 32, the speeds of ink droplets jetted from each nozzle 32 remain stable as long as the nozzle taper angle $\Theta$ is between five and 30 degrees. This kind of constitution reduces the number of defective ink jet printer heads in the manufacturing phase. Thus the ink jet apparatus according to the invention offers enhanced print quality and is highly conducive to mass-production with no need for specialized adjustments of individual nozzles.

Described below is the significance of the relation between the maximum projected area of solid ink particles and the minimum sectional area of the nozzle 32 with respect to the ink jet speed. The inventor measured the jet speeds of ink droplets using various kinds of ink containing different sizes of solid particles. The results were plotted in FIG. 5.

Figure 5:
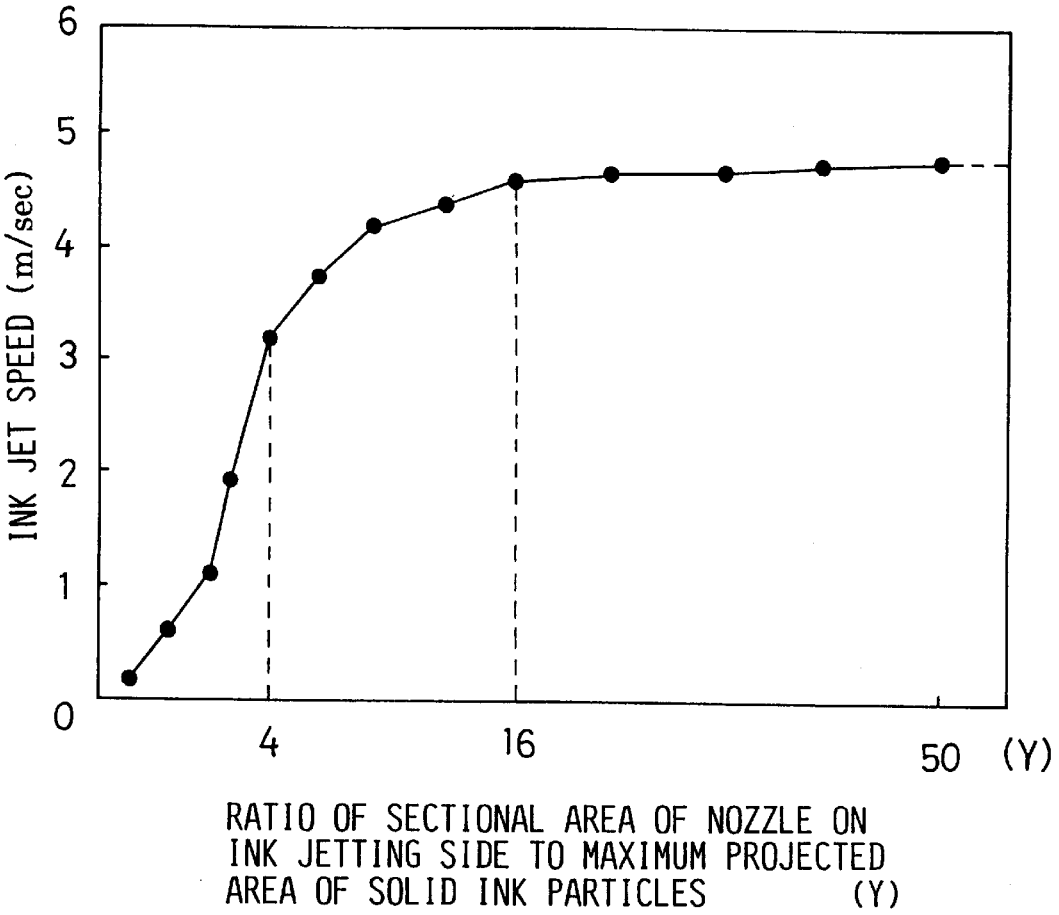
FIG. 5 is a graph exhibiting typical relations between the ratio of the sectional area of each nozzle on the ink jetting side to the maximum projected area of solid ink particles on the one hand, and the ink jet speed on the other in connection with the embodiment.
Figure 6:
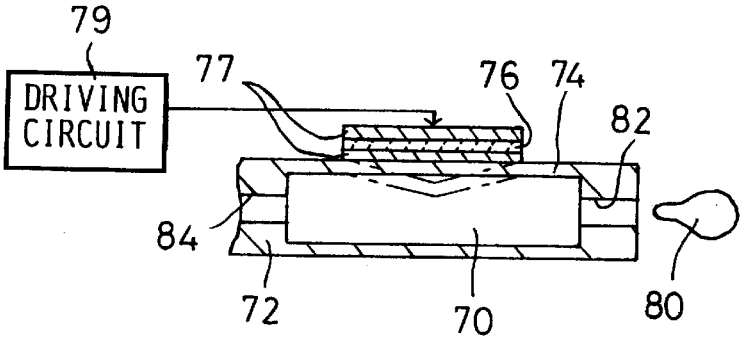
Fig.6 PRIOR ART
FIG. 6 is a partial cross-sectional view of the first example of the typical prior art ink jet apparatus.
Figure 7:
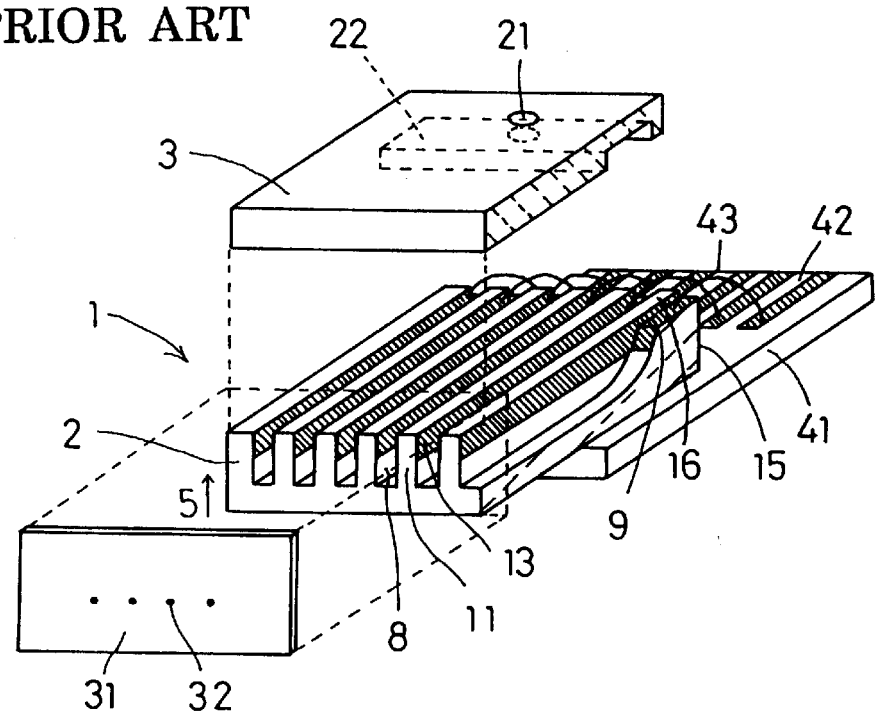
Fig.7 PRIOR ART
FIG. 7 is an exploded perspective view of the second example of the typical prior art ink jet apparatus.
Figure 8:
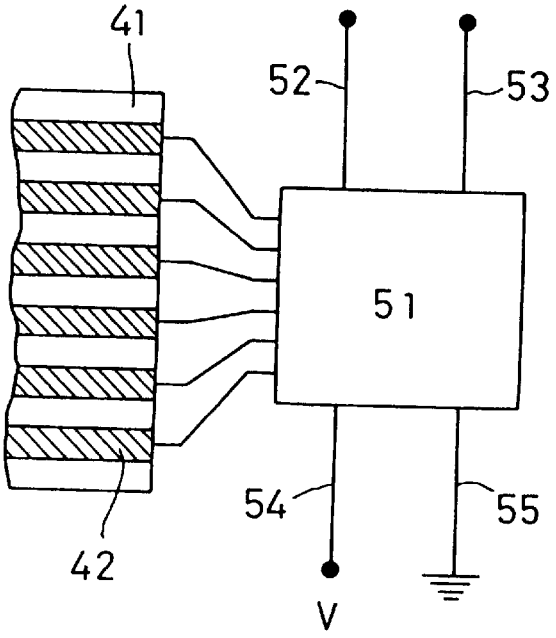
Fig.8 PRIOR ART
FIG. 8 is a schematic sketch of the control section of an ink jet printer head in the second prior art example.
Figure 9:
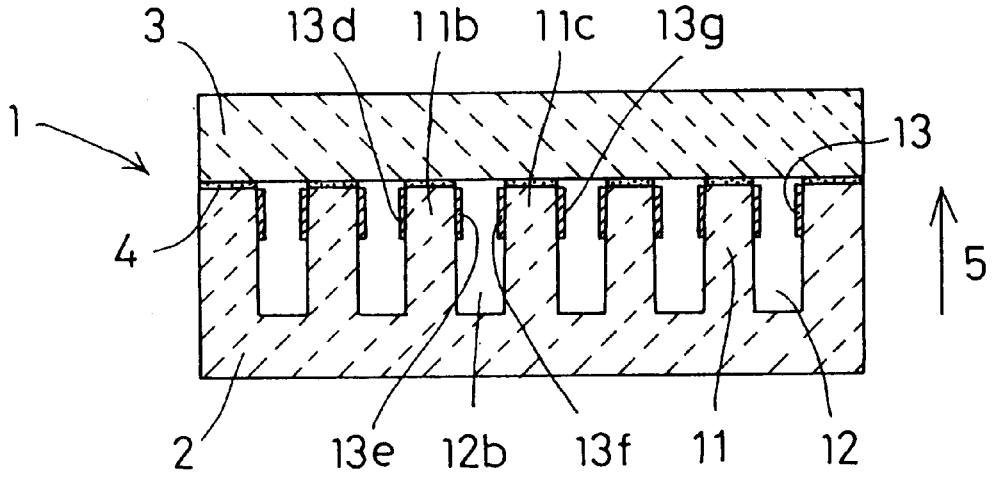
Fig.9 PRIOR ART
FIG. 9 is a front cross-sectional view of the ink jet printer head in the second prior art example.
Figure 10:
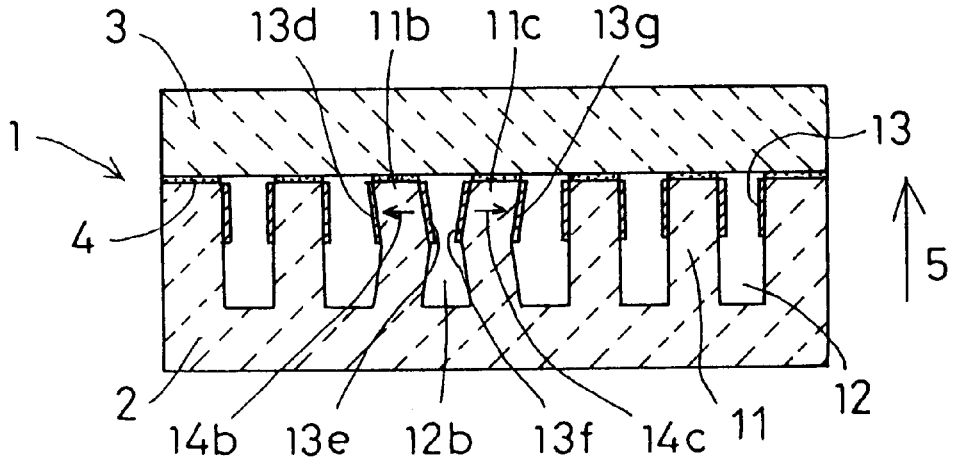
Fig.10 PRIOR ART
FIG. 10 is a front cross-sectional view showing the operation of the ink jet printer head in the second prior art example.

FIG. 5 shows typical relations between the ratio of the sectional area of each nozzle 32 on the ink jetting side to the maximum projected area of solid ink particles on the one hand and the ink jet speed on the other. The relations were measured when the diameter of each nozzle 32 was fixed to 30 $\mu$m on the ink jetting side while the maximum size of solid ink particles was varied. In this setup, the ratio of the sectional area of each nozzle 32 on the ink jetting side to that on the ink channel side ranged from 1:1.5 to 1:15. The taper angle $\theta$ of the nozzle 32 ranged from five to 20 degrees. The center of each nozzle 32 was positioned in the approximate middle of the ink channel 12 as it was flanked by two side walls. Each ink channel 12 was 90 $\mu$m wide and 300 $\mu$m high.

As illustrated in FIG. 5, the measured ink jet speeds were high and stable when the sectional area of the nozzle 32 on the ink jetting. side was at least four times the maximum projected area of solid ink particles and preferably at least 16 times the maximum projected area of solid ink particles. The measured jet speeds of ink droplets were seen deteriorating appreciably when the sectional area of the nozzle 32 on the ink jetting side was less than four times the maximum projected area of solid ink particles. The deterioration is attributable to the friction that occurs when solid ink particles come into contact with the nozzle 32 while ink droplets are being jetted out.

In the above setup, measurements were also taken while the center position of each nozzle 32 was moved within the allowable range designated above. The results obtained were the same. Furthermore, measurements were taken while the diameter of each nozzle 32 was varied on the ink jetting side. The results acquired were also the same.

In the setups used for the measurement above, the minimum sectional area of the nozzle 32 happened to be the sectional area thereof on the ink jetting side. However, the trend obtained was the same as that in FIG. 5 regardless of where the minimum sectional area was located throughout the nozzle 32.

As described, when the minimum sectional area of each nozzle 32 is at least four times the maximum projected area of solid ink particles, the measured jet speeds of ink droplets remain stable. This makes it possible for a single ink jet printer head 1 to jet out a plurality of kinds of ink containing different sizes of solid ink particles. From another point of view, nozzles 32 of the same shape may be used on a plurality of ink jet printer heads 1 addressing a plurality of kinds of ink for color printing. This feature contributes to boosting the level of productivity in manufacturing ink jet printer heads. With the minimum sectional area of each nozzle 32 least four times the maximum projected area of solid ink particles, the jet speeds of ink droplets are kept stable and high. This affords enhanced degrees of freedom to the designing of nozzles 32. Even if manufacturing error causes some deviations in the shape of each nozzle 32, the speeds of ink droplets jetted from each nozzle 32 remain stable as long as the minimum sectional area of each nozzle 32 is at least four times the maximum projected area of solid ink particles. This kind of arrangement reduces the number of defective ink jet printer heads in the manufacturing phase. Thus, the ink jet apparatus according to the invention offers enhanced print quality and is highly conducive to mass-production with no need for specialized adjustments of individual nozzles.

The jet speeds of ink droplets were then measured with the same arrangement and workings as those of the first example of the prior art ink jet apparatus. The results obtained yielded the same trends as those shown in FIGS. 2, 3, 4(B) and 5. The measurements were also taken using the same setup except that the width and height of each ink channel 12 were varied. The acquired results also provided the same trends as those in FIGS. 2, 3, 4(B) and 5. Furthermore, the results were found to be the same when the nozzles 32 were made rectangular or elliptical in cross section instead of round.

As described, the ink jet apparatus according to the invention keeps the jet speed of ink droplets high and stable in any one of the four cases. The first case is when the center position of each of the nozzles is allowed to deviate from the middle between one wall of the corresponding ink channel and the other wall opposite thereto by half the distance between the two walls minus half the diameter of the nozzle within the half distance. The second case is when the ratio of the sectional area of each of the nozzles on the ink jetting side to that on the ink channel side ranges from 1:2 to 1:50. The third case is when the minimum sectional area of each of the nozzles is at least four times the maximum projected area of solid ink particles. The fourth case is when the taper angle Θ at which the diameter of each of the nozzles is narrowed progressively from the ink channel side toward the ink jetting side ranges from five to 30 degrees. All ink jet apparatuses adopting any of the above arrangements provide uniform jet speeds of ink drops jetted out of their nozzles and hence ensure high levels of print quality. Because specialized adjustments of individual nozzles are not needed, the inventive ink jet apparatus is highly conducive to mass-production.

While preferred embodiments of the invention have been described using specific terms, such description is for illustrative purposes only. It is understood that changes and variations may be made without departing from the spirit or scope of the invention defined by the following claims.

What is claimed is:

1. An ink jet apparatus comprising:

a channel plate having a plurality of elongated ink channels formed therein, wherein at least part of said channel plate is made of piezoelectric material and each ink channel of said plurality of elongated ink channels has a longitudinal axis;

an electrode formed on said piezoelectric material adjacent each ink channel, said piezoelectric material being expandable and contractible upon selective application of voltage to each said respective electrode to reduce a volume of said ink channels to forcibly eject ink from said ink channels; and a nozzle plate coupled to said channel plate and having nozzles therein, each nozzle of said nozzles being associated with one of said ink channels and having a central axis aligned with said longitudinal axis of said respective ink channel, said each nozzle having an ink jetting side and an ink channel side;

wherein a ratio of a sectional area of said each nozzle on said ink jetting side to a sectional area of said each nozzle on said ink channel side is in a range of 1:2 to 1:50 in order to stabilize jet speed of the ejected ink.

2. The ink jet apparatus of claim 1 wherein said ratio is in a range of 1:2 to 1:15.

3. The ink jet apparatus of claim 1 wherein each of said ink channels is defined by a pair of spaced side walls having a height, wherein at least a part of said side wall in a direction of the height is a piezoelectric actuator comprising said piezoelectric material polarized in one direction, and an electric field that is generated upon application of voltage to said electrodes is applied to said side wall in a direction perpendicular to the polarization direction of said side wall.

4. The ink jet apparatus of claim 1 wherein said each nozzle has a minimum sectional area, and wherein said minimum sectional area of said each nozzle is at least four times a maximum projected area of a solid ink particle for use in the ink jet apparatus.

5. The ink jet apparatus of claim 4 wherein said minimum sectional area is 16 times a maximum projected area of a solid ink particle for use in the ink jet apparatus.

6. The ink jet apparatus of claim 4 wherein said each nozzle has a diameter and a center and each of said ink channels has a width and a center line, and wherein said each nozzle is aligned with each of said ink channels with said center of said each nozzle being located within half of said width of said ink channel minus half of said diameter of said each nozzle in either half of said width of said ink channel with respect to the center line of each said ink channel.

7. The ink jet apparatus of claim 1 wherein said each nozzle is tapered from said ink chamber side to said ink jetting side, and wherein said each nozzle is tapered at an angle in a range of 5–30°.

8. The ink jet apparatus of claim 7 wherein said each nozzle is tapered at an angle in a range of 5–20°.

9. An ink jet apparatus comprising:

a piezoelectric channel plate having a plurality of channels formed therein, each channel of said plurality of channels having a width and a center line; and a nozzle plate coupled to said channel plate and having nozzles therein that are individually aligned with said ink channels, each nozzle of said nozzles having a diameter, a center and a minimum sectional area, and said each nozzle having an ink channel side and an ink jetting side and being tapered from said ink channel side to said ink jetting side, and wherein said each nozzle is tapered at an angle in a range of 5–30°, and said each nozzle is aligned with each of said ink channels with said center of said each nozzle being located within half of a said width of said ink channel minus half of said diameter of said each nozzle in either half of said width of said ink channel with respect to the center line of each said ink channel, wherein said minimum sectional area of said each nozzle is at least four times a maximum projected area of a solid ink particle for use in the ink jet apparatus and a ratio of the sectional area of said each nozzle on said ink jetting side to the sectional area of said each nozzle on said ink channel side is in a range of 1:2 to 1:50 in order to stabilize jet speed of the ejected ink.

10. The ink jet apparatus of claim 9 wherein said minimum sectional area is 16 times a maximum projected area of a solid ink particle for use in the ink jet apparatus.

11. The ink jet apparatus of claim 9 wherein said each nozzle is tapered at an angle in a range of 5–20°.

12. The ink jet apparatus of claim 9 wherein said ratio is in a range of 1:2 to 1:15.

13. The ink jet apparatus of claim 9 wherein each of said ink channels is defined by a pair of spaced side walls having a height and being separated from each other by said width of said ink channel, wherein an electrode is coupled to each said side wall, wherein at least a part of said side wall in a direction of the height is a piezoelectric actuator polarized in one direction, and wherein an electric field is generated upon application of voltage to said electrodes and is applied to said side wall in a direction perpendicular to the polarization direction of said side wall.

14. The ink jet apparatus of claim 9 wherein each of said nozzles has a central axis parallel to a longitudinal direction of said ink channels.

* * * * *